US006936967B2

(12) United States Patent
Van Den Bogert et al.

(10) Patent No.: US 6,936,967 B2
(45) Date of Patent: Aug. 30, 2005

(54) FLUORESCENT LAMP AND METHOD OF MANUFACTURING SAME

(75) Inventors: Willem Johannes Van Den Bogert, Eindhoven (NL); Suzanne Van Egmond, Roosendaal (NL); Josephus Theodorus Van Der Eyden, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/952,194

(22) Filed: Sep. 14, 2001

(65) Prior Publication Data

US 2002/0070666 A1 Jun. 13, 2002

(30) Foreign Application Priority Data

Sep. 14, 2000 (EP) ..... 00203199

(51) Int. Cl.[7] ..... H01J 1/53
(52) U.S. Cl. ..... 313/626; 313/240
(58) Field of Search ..... 313/567–568, 313/637, 574, 626, 623, 290–292, 578, 284–285, 491–493, 485, 217, 219–221, 240–242, 318, 492, 234

(56) References Cited

U.S. PATENT DOCUMENTS 2,480,282 A * 8/1949 Bigwood ..... 313/581
2,494,916 A * 1/1950 Van Horn ..... 313/231.01
2,668,928 A * 2/1954 Navarre ..... 313/308
3,688,148 A * 8/1972 Fedorenko et al. ..... 313/490
4,204,137 A * 5/1980 Roy ..... 313/491
4,469,983 A * 9/1984 Grahmann et al. .... 313/318.07
4,891,551 A * 1/1990 Will et al. ..... 313/492
4,975,620 A * 12/1990 Masui et al. ..... 313/624
5,004,949 A * 4/1991 Latassa et al. ..... 313/492
5,500,567 A * 3/1996 Wilson et al. ..... 313/490
5,600,199 A * 2/1997 Martin et al. ..... 313/318.02
5,698,947 A * 12/1997 Choi ..... 313/623
5,754,000 A * 5/1998 Skilton et al. ..... 313/565
6,211,618 B1 * 4/2001 Fancher et al. ..... 315/49
6,522,068 B2 * 2/2003 Van Egmond et al. ..... 313/567

* cited by examiner

*Primary Examiner*—Joseph Williams
*Assistant Examiner*—Dalei Dong

(57) ABSTRACT

Fluorescent lamp (1) having a glass discharge vessel (2) in which a gas is present, which discharge vessel (2) is provided with a tubular end portion (3) having a longitudinal axis, which end portion (3) includes a glass stem (5), wherein an exhaust tube (6) extends axially outward from said stem (5) for supplying and/or discharging gases during the production of the lamp (1), wherein an electrode (8) extends axially inward through the stem (5) for maintaining a discharge in the discharge vessel (2), wherein the inwardly disposed end (10) of the electrode (16) is radially surrounded by a shield (15) for intercepting material emitted by the electrode (16), which shield (15) is mounted on an elongate support (16) which extends inward from the stem (5), and wherein said support (16) extends outward through the stem (5) into the exhaust tube (6).

10 Claims, 2 Drawing Sheets

FLUORESCENT LAMP AND METHOD OF MANUFACTURING SAME

BACKGROUND OF THE INVENTION

The invention relates to a fluorescent lamp comprising a glass discharge vessel in which a gas is present, which discharge vessel is provided with at least one tubular end portion having a longitudinal axis, which end portion is provided with a glass stem, while an exhaust tube extends axially in outward direction from the stem for the supply and/or discharge of gases during manufacture of the lamp, and an electrode extends axially in inward direction through the stem for maintaining a discharge in the discharge vessel during operation, the innermost end of the electrode being surrounded in radial direction by a shield for intercepting material sputtered off from the electrode, which shield is fastened on an elongate support which extends in inward direction from the stem.

An example of such a fluorescent lamp is the TL lamp of the Philips™ brand, with type no. F32T8 (also referred to as ALTO™ T8), a low-pressure mercury vapor discharge lamp which is commercially available.

Mercury is the primary component for the (efficient) generation of ultraviolet (UV) light in mercury vapor discharge lamps. A luminescent layer comprising a luminescent material (for example a fluorescent powder) is present on the inside wall of the discharge vessel for the conversion of UV into other wavelengths, for example into UV-A and UV-B for suntanning purposes (sun couch lamps), or visible radiation for general lighting purposes. The discharge vessel of a fluorescent lamp usually has a circular cross-section, and there are both elongate linear embodiments (TL tubes) and compact embodiments (energy-saving lamps). In the TL tube, said tubular end portions lie in one another's extended directions and form a long, straight tube, whereas in an energy-saving lamp they are interconnected by means of a bent tubular portion or a so-called bridge.

The fluorescent lamp is evacuated during manufacture through the glass exhaust tubes which are present at either end of the lamp. The desired gas mixture is subsequently introduced into the lamp through the same exhaust tubes, whereupon the exhaust tubes are closed by pinching or fusion.

During operation, a voltage is maintained between the electrodes, which are also present at the two ends of the lamp, so that a continuous discharge takes place and the mercury vapor emits the UV light mentioned above. The ends of the electrodes are radially surrounded each by a shield because small particles are regularly emitted by the electrodes during operation, which particles would end up on the inside wall of the discharge vessel. This is undesirable because it reduces the light output in situ, so that the lamp will have an uneven light output, which is why the particles are intercepted by the shield. The shield is fastened in the glass stem by means of a wire-type support.

The problem which may arise in such a fluorescent lamp is that, towards the end of lamp life when the electrodes have been partly exhausted, the discharge may continue between portions of the electrodes which were not designed for this purpose, during which the stem will be covered with metal particles originating from said portions of the electrodes. The shield, indeed, protects in radial directions only. As a result, the outer surface of the stem becomes conductive, with the result that the discharge applies itself thereto, and the stem becomes so hot that it softens and is deformed. The result is that the support with the shield, which is anchored in the stem, tilts and comes into contact with the electrode, and thus becomes part of this electrode electrically. In that case the shield will take over the electrode function. Owing to an unfavorable heat distribution, the wall of the discharge vessel may become excessively hot for a longer period as a result of this. It may eventually even happen that the shield sags against the glass discharge vessel, and that the latter is destroyed by the heat.

OBJECTS AND SUMMARY OF THE INVENTION

It is an object of the invention to provide a reliable fluorescent lamp in which the risk of the protective shield sagging at the end of lamp life is reduced in a simple and efficient manner.

To achieve this object, the support of the shield extends through the stem in outward direction into the exhaust tube. Preferably, the support bears on the inside of the exhaust tube. More preferably, the support bears on the inside of the exhaust tube in at least two different locations, seen in axial direction, or the support bears on the inside of the exhaust tube over a certain length, seen in axial direction. Preferably, the support clamps itself against the inside of the exhaust tube, and the portion of the support present in the exhaust tube is preferably elastically deformable. These measures have the result that the support is anchored not only in the stem, but is also supported against or in the exhaust tube, with or without clamping action. Since the exhaust tube extends in outward direction, it will retain a comparatively low temperature and will not become softened, so that the support and thus also the shield remain in a stable position with respect to the discharge vessel and the electrode, also if the stem should soften.

Preferably, the support extends through the stem along the longitudinal axis such that it is centered in the discharge vessel.

Preferably again, the end of the support present in the exhaust tube has sloping guide surfaces which are capable of guiding and centering the support during its insertion into the exhaust tube, which promotes a simple lamp manufacture. Preferably, the support is manufactured from bent metal wire, which is an inexpensive and efficient solution for achieving the set objective.

The invention also relates to a method of manufacturing a fluorescent lamp, whereby a glass discharge vessel is provided with a tubular end portion having a longitudinal axis at both ends, said end portion being provided with a glass stem, while an electrode is passed through the stem in axial inward direction for generating and maintaining a discharge in the discharge vessel, and the innermost end of the electrode is surrounded in radial direction by a shield for intercepting material emitted by the electrode, which shield is fastened on an elongate support which extends from the stem in inward direction, and whereby an exhaust tube is provided in axial outward direction from the stem, through which exhaust tube the discharge vessel is filled with a gas, and the support is positioned such that it extends through the stem in outward direction into the exhaust tube.

BRIEF DESCRIPTION OF THE DRAWING

The invention will now be explained with reference to the embodiments shown in the Figures, in which.

The figures are purely diagrammatic and not drawn to scale. Some dimensions have been particularly exaggerated for the sake of clarity. Similar components have been given the same reference numerals as much as possible in the Figures.

DESCRIPTION OF THE PREFERRED EMBODIMENTS

Figure 1:
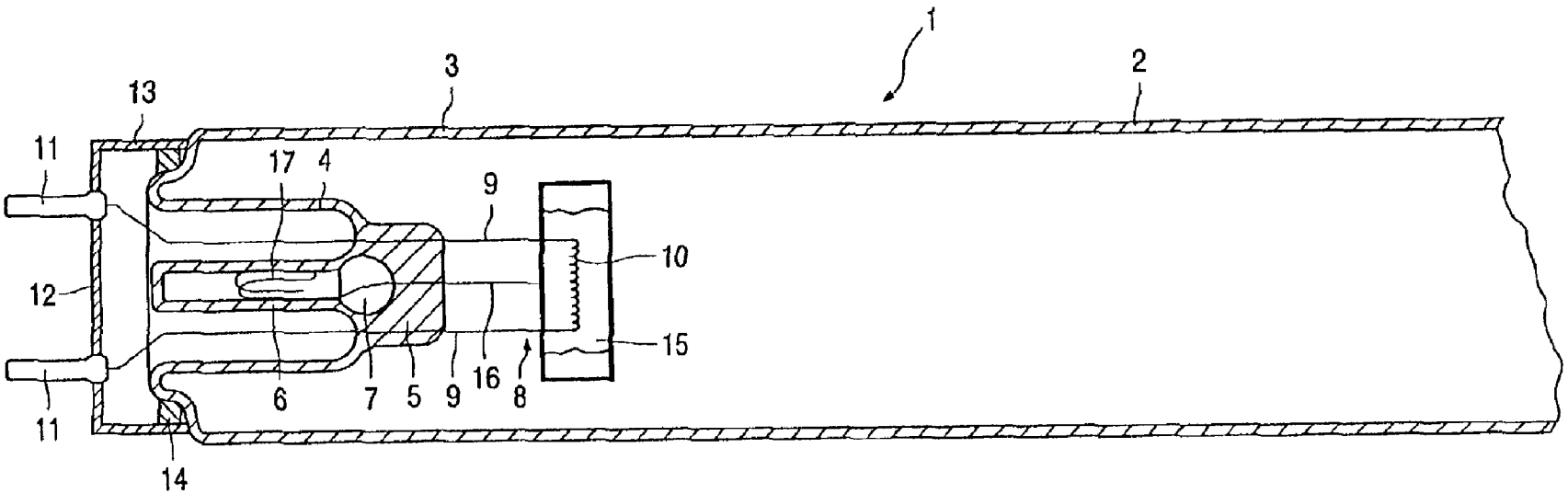
FIG. 1 is a partial cross-sectional view of a fluorescent lamp.

In FIG. 1, a fluorescent lamp 1 comprises a glass discharge vessel in the form of a tube 2. The Figure shows only an end portion 3 of the lamp 1, in actual fact the lamp comprises two mutually opposed, identical end portions 3 each closing off one end of a long glass tube 2. The glass tube 2 is provided at its inside with a layer of fluorescent material capable of converting UV light into UV-A, UV-B, or visible light.

The glass tube 2 comprises at its end a cylindrical carrier 4 which extends in inward direction and on which a base block 5 (or pinch) is provided after supply wires 9 and the support 16 have been fused therein. An exhaust tube 6 extending to the exterior is provided on the base block 5, which exhaust tube is in open communication with the contents of the tube 2 through a hole 7 in the base block 5. Before the lamp 1 is finished, the tube 2 is evacuated through the exhaust tube 6, which then still has a greater length than shown here, and the tube 2 is filled with the desired (rare) gas mixture. A quantity of mercury is also provided in the lamp. Then the exhaust tube 6 is heated, so that the glass softens, and it is pinched shut at the length shown and tipped, so that the tube 2 is hermetically closed.

The lamp 1 is furthermore provided at either end with an electrode 8 which comprises two supply wires 9 and a tungsten coiled wire 10. The coiled wire 10 is coated with a layer of emitter material (comprising inter alia barium, strontium, calcium, and various oxides) for promoting the emission of electrons. The supply wires 9 are held by the stem 5, in which the wires are sealed adjacent the lateral edges, and are furthermore connected to contact pins 11. The contact pins 11 are held in an electrically insulating disc 12 which forms part of a metal lamp cap 13. The lamp cap 13 is fastened to the glass tube by means of an annular glue layer 14.

The contact pins 11 can be fastened in a luminaire which provides the lamp 1 with power. The discharge generated thereby between the electrodes 8 ensures that the mercury vapor molecules emit UV light, which is converted into light of the desired wavelength(s) by the fluorescent layer on the inside of the tube 2.

A shield 15 is arranged around the coiled wire 10 for the purpose of preventing material which has sputtered off the coiled wire 10 as a result of the discharge maintained between the electrodes during operation from moving sideways and ending up on the inside of the tube 2, which would interfere with an even light output over the length of the tube. This shield 15 is manufactured from a strip of metal which was bent into an at least substantially closed circumference of oval shape. The shield 15 is cut away partly in the Figure, so that the coiled wire 10 is well visible. The shield 15 is kept in place by a wire-type bent metal support 16 which is fused into the stem 5, as are the supply wires 9, but in the central portion of this stem. The support 16 may be manufactured, for example, from iron, nickel, iron/nickel, chromium/nickel, or molybdenum.

The shield 15 is fastened to the end of the portion of the support 16 extending in inward direction, whereas the clamping portion 17 of the support 16 extending in outward direction extends into the exhaust tube 6. This clamping portion 17 has a shape such that it clamps itself elastically inside the exhaust tube 6 over a certain length, so that the shield 15 is satisfactorily kept in place, also if the stem 5 should be softened by heat. In the embodiment shown here, the clamping portion 17 has the shape of a kind of three-dimensional paperclip such that it bears on the inside wall of the exhaust tube 6 in four locations. Such a shape has the additional advantage that the end of the clamping portion has sloping guiding surfaces, so that the support can be guided to the inside and centered in a simple manner during its insertion into the exhaust tube.

Figure 2A:
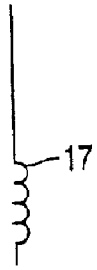
FIGS. 2A to 2C diagrammatically show a number of examples of possible shapes of that portion of the support which extends in the exhaust tube of the fluorescent lamp.
Figure 2B:
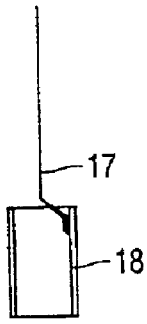
Figure 2C:
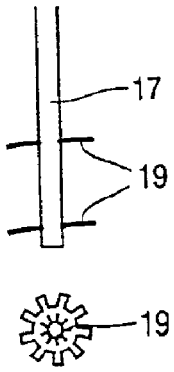

FIGS. 2A to 2D show a number of examples of possible modifications of the clamping portion 17. FIG. 2A shows a helically curved metal wire, the cross-section of the turns corresponding to the inside diameter of the exhaust tube 6. FIG. 2B shows a metal wire which is fastened in a metal tube 18, the outer diameter of the tube corresponding to the inside diameter of the exhaust tube 6. FIG. 2C shows a metal wire provided with two starshaped flexible holders each having a cross-section slightly greater than the inside diameter of the exhaust tube 6. Many modifications, however, are conceivable for supporting the support 16 in the exhaust tube 6.

It will be obvious that many variations are possible to those skilled in the art within the scope of the invention.

The scope of protection of the invention is not limited to the embodiments described. The invention resides in each novel characteristic and all combinations of characteristics. Reference numerals in the claims do not limit the scope of protection thereof. The use of forms of the verb "comprise" does not exclude the presence of elements other than those mentioned in the claims. The use of the indefinite article "a" or "an" preceding an element does not exclude the presence of a plurality of such elements.

What is claimed is:

1. A fluorescent lamp comprising a glass discharge vessel in which a gas is present, which discharge vessel is provided with at least one tubular end portion having a longitudinal axis, which end portion is provided with a glass stem, while an exhaust tube extends axially in outward direction from the stem for the supply and/or discharge of gases during the manufacture of the lamp, and an electrode extends axially in inward direction through the stem for maintaining a discharge in the discharge vessel during operation, the innermost end of the electrode being surrounded in radial direction by a shield for intercepting material sputtered off from the electrode, which shield is fastened on an elongate support which extends in inward direction from the stem, characterized in that said support extends entirely through the stem and exits the stem in outward direction and then extends beyond the stem in outward direction to enter inside the exhaust tube.

2. A fluorescent lamp as claimed in claim 1, characterized in that the support comprises a clamping portion which bears on the inside of the sidewall of the exhaust tube.

3. A fluorescent lamp as claimed in claim 2, characterized in that the support clamping portion bears on the inside of the exhaust tube in at least two different locations, seen in axial direction.

4. A fluorescent lamp as claimed in claim 2, characterized in that the support clamping portion bears on the inside of the exhaust tube over a certain length, seen in axial direction.

5. A fluorescent lamp as claimed in claim 2, characterized in that the support clamping portion clamps itself against the inside of the exhaust tube.

6. A fluorescent lamp as claimed in claim 2, characterized in that the clamping portion of the support lying in the exhaust tube is elastically deformable.

7. A fluorescent lamp as claimed in claim 2, characterized in that the clamping portion of the support lying in the exhaust tube has sloping guide surfaces which are capable of guiding and centering the support during its insertion into the exhaust tube.

8. A fluorescent lamp as claimed in claim 2, characterized in that the support is manufactured from bent metal wire.

9. A fluorescent lamp as claimed in claim 1, characterized in that the support extends through the stem along the longitudinal axis.

10. A method of manufacturing a fluorescent lamp, whereby a glass discharge vessel is provided at both ends with a tubular end portion having a longitudinal axis, said end portion being provided with a glass stem, while an electrode is passed through the stem in axial inward direction for generating and maintaining a discharge in the discharge vessel, and the innermost end of the electrode is surrounded in radial direction by a shield for intercepting material emitted by the electrode, which shield is fastened on an elongate support which extends from the stem in inward direction, and whereby an exhaust tube is provided in axial outward direction from the stem, through which exhaust tube the discharge vessel is filled with a gas, characterized in that the support is positioned such that it extends entirely through the stem and exits the stem in outward direction and then extends beyond the stem in outward direction to enter into the exhaust tube.

* * * * *